US005817443A

United States Patent [19]

Matsushima et al.

[11] Patent Number: 5,817,443

[45] Date of Patent: Oct. 6, 1998

[54] TONER FOR STATIC CHARGE DEVELOPING AND FIXING METHOD

[75] Inventors: Asao Matsushima; Shigenori Kouno; Kazuya Isobe; Yoshiaki Kobayashi; Kaori Soeda; Meizo Shirose, all of Hachioji, Japan

[73] Assignee: Konica Corporation, Japan

[21] Appl. No.: 958,307

[22] Filed: Oct. 27, 1997

[30] Foreign Application Priority Data

| | | | |
|---|---|---|---|
| Oct. 30, 1996 | [JP] | Japan | 8-288029 |
| Nov. 1, 1996 | [JP] | Japan | 8-291592 |
| Mar. 21, 1997 | [JP] | Japan | 9-067563 |

[51] Int. Cl.[6] ..... G03G 9/087

[52] U.S. Cl. ..... 430/109; 430/111

[58] Field of Search ..... 430/109, 111

[56] References Cited

U.S. PATENT DOCUMENTS

| | | | |
|---|---|---|---|
| 5,281,505 | 1/1994 | Inoue et al. | 430/105 |
| 5,362,593 | 11/1994 | Inoue et al. | 430/111 |
| 5,508,138 | 4/1996 | Shimizu et al. | 430/99 |
| 5,514,511 | 5/1996 | Iwamoto et al. | 430/110 |

*Primary Examiner*—Roland Martin

*Attorney, Agent, or Firm*—Jordan B. Bierman; Bierman, Muserlian and Lucas

[57] ABSTRACT

Toner for developing electro-static image is disclosed. The toner comprises at least a resin and a colorant, and the resin is composed of a vinyl-based polymer. The component dissolved in tetrahydrofuran (THF) of the resin has a peak molecular weight at the molecular weight region of 5,000 or more and less than 150,000 and at the molecular weight region of 300,000 or more and less than 500,000. The storage elastic module $G'_{160}$ at 160° C. of the toner is 500–1200 dyn/cm$^2$ and loss elastic module $G''_{160}$ at 160° C. of the toner is 1500–3000 dyn/cm$^2$.

6 Claims, 3 Drawing Sheets

TONER FOR STATIC CHARGE DEVELOPING AND FIXING METHOD

The present invention relates to a toner for static charge developing used in an image forming method such as an electrophotography method, an electro-static recording method and an electro-static printing method and a fixing method by means of pressure heating.

BACKGROUND OF THE INVENTION

Heretofore, in full-color image forming, color reproducibility, glossiness and light transmissivity, specifically, in the case of an image for OHP (over-head projector) of the image are demanded.

In order to improve on the above-mentioned properties, it is necessary to minimize internal stress and cracking of the toner image after fixing which is the final image and to flatten the image surface in order to prevent irregular reflection inside and on the surface of the image as much as possible.

From the above-mentioned viewpoint, in order to easily transfer heat and sufficiently conduct heat fixing, it is preferable to employ a heating roller fixing process, which is a kind of pressure heat fixing, and which employs a soft roller having favorable compatibility with any unevenness on the surface of the unfixed image by means of toner. In addition, as a color toner used for full-color copying, it is necessary that a flat surface is easily formed by means of pressure heating during fixing, namely, elasticity under heated temperature is negligible.

However, since color toner having small elasticity when molten, easily causes hot off-set, there is a problem that the range of temperature capable of fixing is narrow. According to prior art, against the above-mentioned problem, it was necessary to inhibit the occurrence of the hot off-set by coating oil in a large amount on the fixing roller when fixing toner. In the color toner having small elasticity under fixing temperature, molecular weight of binder resin constituting the above-mentioned color toner is small. Therefore, it does not have sufficient mechanical strength as toner particles.

For example, Japanese Patent Publication open to Public Inspection (hereinafter, referred to as Japanese Patent O.P.I. Publication) No. 2-135459 discloses a technology to employ a low molecular weight and a low softening point styrene-acrylic-based resin for a binder resin. Aforesaid resin is extremely fragile and low in hardness. Therefore, when a color toner employing aforesaid binder resin is employed, toner particles are crushed due to stirring in the developing device, tending to result in fine particles. In addition, on the surface of toner particles which has low hardness, additives particles are easily buried.

Since toner particles in which fine particles and additives particles are buried due to crushing has a large adhesive force on the carrier, and subsequently developability on the photoreceptor is reduced. In addition, there is another problem that reduction of image transfer property results, since the toner particles on which the crushed fine particles and additives particles are buried have noticeable adhesive force on the surface of the photoreceptor.

SUMMARY OF THE INVENTION

A first object of the present invention is to provide a fixing image excellent in the flatness of the surface without need of coating a large amount of oil. Another object of the present invention is to provide toner provided with sufficient strength not being crushed due to stress caused by stirring in the developing device and which also has high hardness to counter burying of additives.

The present invention and its embodiments are shown.

The toner comprises at least a resin and a colorant, and the resin is composed of a vinyl-based polymer. The component dissolved in tetrahydrofuran (THF) of the resin has a peak molecular weight at the molecular weight region of 5,000 or more and less than 15,000 and at the molecular weight of 300,000 or more and less than 50,000. The storage elastic module $G'_{160}$ at 160° C. of the toner is 500–1200 dyn/cm$^2$ and loss elastic module $G''_{160}$ at 160° C. of the toner is 1500–3000 dyn/cm$^2$.

The ratio (SLp/SHp) of area of low molecular weight component (SLp) having molecular weight of 1,500 to 80,000 of the component dissolved in tetrahydrofuran (THF) of the resin to area of high molecular weight component (SHp) having molecular weight of 80,000 or more and less than 1,000,000 of the component dissolved in tetrahydrofuran (THF) of the resin is preferably 5–15.

The low molecular weight component of the above-mentioned polymer is preferably an ionomer.

The low molecular weight component is preferably an ionomer and a polymer having a structural unit obtained from a monomer represented by Formula (a) or (b).

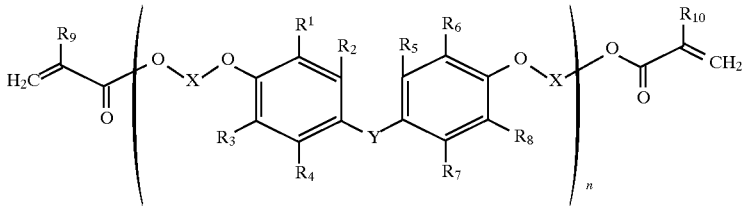

Formula (a)

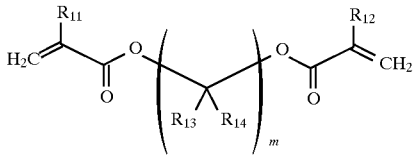

Formula (b)

In Formulas, $R_1$ through $R_8$ independently represent a hydrogen atom, a halogen atom, a substituted or unsubstituted alkyl group having 1 through 10 carbon atoms, a cycloalkyl group and an aryl group. $R_9$ and $R_{10}$ independently represent a hydrogen atom and a chained or cyclic alkyl group having 1 through 6 carbon atoms. X represents a chained alkylene group having 1 through 6 carbon atoms, a polymethylene group, a chained or cyclic alkylidene group having 2 through 6 carbon atoms or a mere bonding group. Y represents a chained alkylene group and a polymethylene group respectively having 1 through 6 carbon atoms or a chained or cyclic alkylidene group, an aryl-substituted alkylidene group, a sulfonyl group, a sulfide group, an —O— group or a mere bonding group respectively having 2 through 10 carbon atoms. n represents numbers of 1 through 5.

$R_{11}$ and $R_{12}$ independently represent a hydrogen atom and a chained or cyclic alkyl group respectively having 1 through 6 carbon atoms. $R_{13}$ and $R_{14}$ independently represent a hydrogen atom and a substituted or unsubstituted alkyl group, cycloalkyl group and aryl group respectively having 1 through 10 carbon atoms. $R_{13}$ and $R_{14}$ may be the same or different. Further, $R_{13}$ and $R_{14}$ may be linked together for forming a ring. m represents a number of 3 through 20.

Toner image developed and formed by toner for electrostatic developing is fixed on a recording medium by means of a pressure and heating fixing device.

It is preferable that the storage elastic module $G'_{180}$ at 180° C. is 300–1000 dyn/cm$^2$, the loss elastic module $G''_{180}$ at 180° C. is 800–2300 dyn/cm$^2$, the storage elastic module $G'_{160}$ at 160° C. is 500–1200 dyn/cm$^2$, the loss elastic module $G''_{160}$ at 160° C. is 1500–3000 dyn/cm$^2$ and $G'_{160}>G'_{180}$ and $G''_{160}>G'_{180}$.

The colorant is either a yellow, magenta, cyan or a black colorant.

Figure 1:
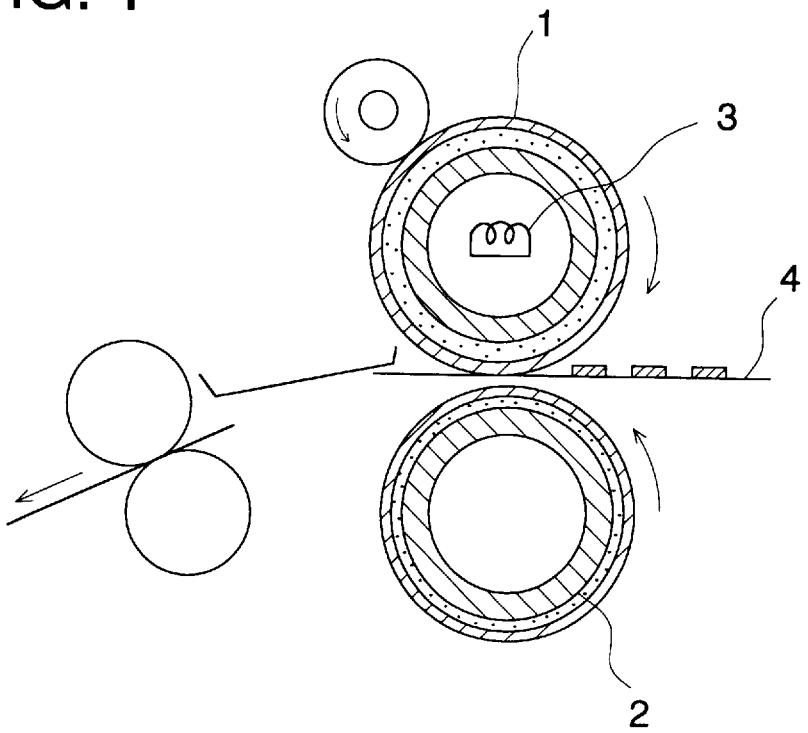
FIG. 1 shows an explanation drawing of an example of a fixing method by means of a heat roll fixing method.

1 Upper roller
2 Lower roller
3 Heater
21 Line-shaped heating material
22 Fixing film
23 Pressure roller
31 Heating material
32 Feeding shaft
33 Winding shaft
34 Double-ended film
35 Pressure roller
41 Upper roller
42 Roller surface
43 Cylinder
44 Heating source
45 lower roller
46 Recording medium
47 Toner image
48 Impregnating roller

DETAILED DESCRIPTION OF THE INVENTION

To have a peak molecular weight, it is preferred that a molecular weight apparently exhibiting a peak-shaped maximum value existing in a chromatogram measured by Gel Permeation Chromatography (GPC), in which the horizontal axis represents molecular weight and the vertical axis represents molecule number corresponding to the respective molecular weight.

When measuring, a resin is dissolved in tetrahydrofuran (THF) and then its soluble portion is measured.

GPC measurement method

When measuring the molecular weight distribution of resin, the tetrahydrofuran (THF)-soluble portion in toner is measured in terms of molecular weight distribution of a chormatogram by means of GPC in which THF is used as a solvent. The measurement method is as follows.

Measured samples were prepared in the following manner:

A sample and tetrahydrofuran (THF) are mixed in a density of 0.5–5 mg/ml (for example, 5 mg/ml). After leaving the mixture for several hours (for example, 5–6 hours) at room temperature, the mixture is then sufficiently stirred. The mixture is mixed until any solidity of THF and the sample are removed. Further, the resulting mixture is left for 12 hours or more (for example, 24 hours) at room temperature. In this occasion, it is arranged that time since mixture of the sample and THF until the end of leaving is 24 hours or more (for example, 24–30 hours).

Following this, the resulting mixture is subjected to filtration with a sample-processing filter (Pore-size, 0.45–0.5 μm, for example, a Myshori Disk H-25-5 produced by Tohsoh and a Ekichro-disk 25CR German produced by Science Japan Inc. can be utilized). The resulting mixture is used as a sample for GPC. The sample density is prepared in such a manner that the toner component is 0.5–5 mg/ml).

In a GPC measuring apparatus, the column is stabilized in a heat chamber at 40° C. To the column at this temperature, THF is introduced in as a solvent at a flow rate of 1 ml/min. In addition, about 100 μl of THF sample solution is injected for measurement. When measuring the molecular weight of the sample, the distribution of the molecular weight which the sample has is calculated from the relationship of the logarithmic value of the calibration curve prepared by several kinds of mono-dispersed polystyrene standard samples and the counted number.

As a standard polystyrene sample for calibration curve preparation, those having molecular weight of $10^2$–$10^7$ produced by Tohsoh or Showa Denko may be employed. It is suitable to use at least 10 standard polystyrene samples. As a detecting element, an RI (refractive index) detecting element may be used. As a column, it is favorable to combine several commercially available polystyrene gel columns. For example, a combination of Shodex GPC KF-801, 802, 803, 804, 805, 806, 807 and 800P produced by Showa Denko and TSK gel G1000H($H_{XL}$), G2000H($H_{XL}$), G3000H($H_{XL}$), G4000H($H_{XL}$), G5000H($H_{XL}$), G6000H ($H_{XL}$), G7000($H_{XL}$) and a TSK guard column are cited.

Measuring method of visco-elasticity

Storage elasticity module G' and loss elasticity module G" are respectively referred to as values (dyne/cm$^2$) measured by a Cone plate method employing rheometer "Solikidmeter: model MR-500" (produced by Nippon Rheology Inc.). Here, as measurement conditions, cone angle was 2.0 deg, cone diameter was 4.0 cm, frequency was 1.0 Hz, the twist angle was 0.5 deg, gap length was 50 μm, measurement starting temperature was 100° C. and the temperature rising rate was 3° C./min.

The storage elastic module of the toner at 160° was $G'_{160}$ and loss elastic module at 160° C. was $G''_{160}$, storage elastic module of toner at 180° C. was $G'_{180}$ and loss elastic module at 180° C. was $G''_{180}$.

In order to obtain favorable flatness on the surface of the image and also favorable glossiness, it is preferable that the storage elastic module $G'_{160}$ of toner at 160° C. does not exceed 1200 dyn/cm$^2$ and that the loss elastic module $G''_{160}$ at 160° C. does not exceed 3000 dyn/cm$^2$.

In order to obtain suitable flatness on the surface of the image for obtaining visible image and not to cause the occurrence of problems such as off-setting and to obtain high durability, it is preferable that the storage elastic module $G'_{160}$ of toner at 160° C. is not lower than 500 dyn/cm$^2$ and that loss elastic module $G''_{160}$ at 160° C. is not lower than 1500 dyn/cm$^2$.

If the storage elastic module $G'_{180}$ of toner at 180° C. does not exceed 1000 dyn/cm$^2$ and that the loss elastic module $G''_{180}$ at 180° C. does not exceed 2300 dyn/cm$^2$, acceptable wettability and adhesive property onto a recording medium is obtained and favorable fixing is conducted.

If the storage elastic module $G'_{180}$ of toner at 180° C. is not lower than 300 dyn/cm$^2$ and that the loss elastic module $G''_{180}$ at 180° C. is not lower than 800 dyn/cm$^2$, it is difficult to cause the occurrence of the off-set problem.

It is preferable to be $G'_{160}>G'_{180}$ and $G''_{160}>G''_{180}$ in terms of stabilizing glossiness.

With regard to a vinyl-based binder resin usable in the toner, in order to obtain basic properties such as charging property and crushability as toner, it is preferable to use styrene resin, acrylic acid ester or methacrylic acid ester monomers as a base unit.

As practical examples of styrene monomers, in addition to styrene, o-methylstyrene, p-methylstyrene, α-methylstyrene, p-ethylstyrene, 2,4-dimethylstyrene, p-n-butylstyrene, p-terbutylstyrene, p-n-hexylstyrene, p-n-octylstyrene, p-n-dodecylstyrene, p-methoxystyrene, p-phenylstyrene, P-chlorostyrene and 3,4-dichlorostyrene are cited.

As practical examples of acrylic acid ester or methacrylic acid ester monomers, in addition to alkyl ester of acrylic acid or methacrylic acid, acrylic acid methyl, acrylic acid ethyl, acrylic acid propyl, acrylic acid n-butyl, acrylic acid isobutyl, acrylic acid n-octyl, methacrylic acid dodecyl, methacrylic acid 2-ethylhexyl, acrylic acid stearyl, methacrylic acid methyl, methacrylic acid ethyl, methacrylic acid propyl, methacrylic acid n-butyl, methacrylic acid isobutyl, methacrylic acid n-octyl, methacrylic acid dodecyl and methacrylic acid stearyl, acrylic acid 2-chloroethyl, acrylic acid phenyl, α-chloroacrylic acid methyl, methacrylic acid phenyl, methacrylic acid dimethylaminoethyl, methacrylic acid diethylaminoethyl, methacrylic acid 2-hydroxyethyl, methacrylic acid glycidyne, bisglycidylmethacrylate, polyethylene glycol dimethacrylate and methacryloxyethylphosphate are cited. Acrylic acid ethyl, acrylic acid propyl, acrylic acid butyl, metharylic acid methyl, methacrylic acid ethyl, methacrylic acid propyl and methacrylic acid butyl are preferably used.

As other vinyl-based monomers, acrylic acid and its α- or β-alkyl derivative such as α-ethylacrylic acid and chrotonic acid; unsaturated dicarbonic acid and its monoester derivative and diester derivative such as phmalic acid, maleic acid, citraconic acid and itaconic acid; succinic acid monoacryloyloxyethylester, succinic acid monomethacryloyloxyethylester, phmalic acid monoacryloyloxyethylester, phmalic acid monomethacryloyloxyetylester, acrylonitrile and acrylic amide can be cited.

One example to control storage elastic modules $G'_{160}$ and $G'_{180}$ and loss elastic module $G''_{160}$ and $G''_{180}$ is to employ compounds represented by Formula (a) or Formula (b) as a monomer component in a low molecular weight component appropriately.

Preferable amount used of the above-mentioned monomer is 0.1–10 wt % and more preferable amount is 0.3–6 wt % in a vinyl-based binder resin component.

A suitable amount to obtain an appropriate storage elastic module and loss elastic module can be obtained by a simple experiment in reference to a description in an example to be exhibited later.

Since the above-mentioned monomers represented by formula (a) or (b) produce network-like bridging among the vinyl-based polymer, mechanical strength of the toner is enhanced. Therefore, during manufacturing of the toner, excessive crushing in a crushing step is prevented and crushing of the toner due to mechanical impact force in a developing device is reduced. Therefore, the occurrence of fogging due to the resulting fine powder is prevented so that stable images can be obtained for a long period.

In addition, since the above-mentioned vinyl-based polymer is bridged gently due to the monomer, represented by formula (a) or (b), having a straight chain of long molecules the molten viscosity of the binder for the toner itself does not become extremely high. Accordingly, a sufficiently low temperature fixing property can be maintained. Specifically, while improving the mechanical strength of a toner binder resin for a high glossy full color, the desired effects are brought about without reducing glossiness of the finished image.

Since a vinyl-based binder resin contains a vinyl-based binder resin bridged with a polymerized monomer, represented by formula (a) or (b), having a main chain of a long molecular length as a constitution component, mechanical strength of a resin can be enhanced. Accordingly, excessive crushability can be improved without damaging the crushability of the toner. In addition, crushability inside a developing device can be inhibited. Therefore, image deterioration due to fogging caused by toner fine particles can be prevented accordingly.

In addition, since a binder resin is gently bridged by means of the above-mentioned polymerized monomer, a sufficiently low-temperature fixing property can also be maintained. Further, molecular weight distribution is broadened at high molecular weights due to aforesaid bridging, anti-hot off-setting property can be improved without noticeably raising the softening point.

Practical examples of compounds represented by Formulas (a) and (b) follow:

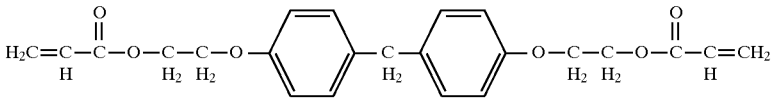

a-1

-continued
a-2
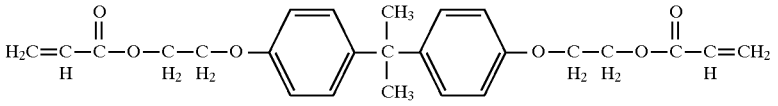
a-3
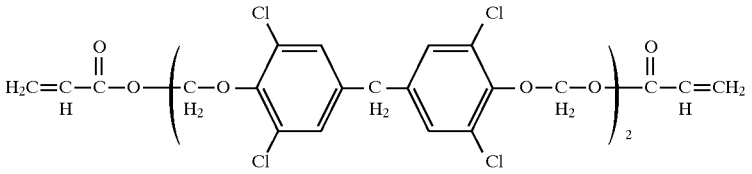
a-4
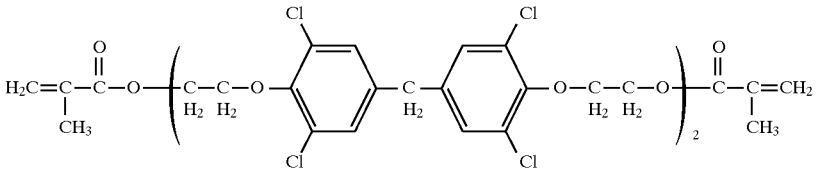
a-5
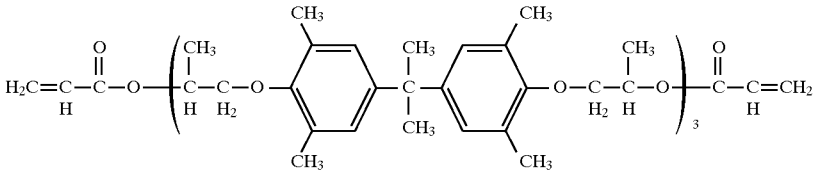
a-6
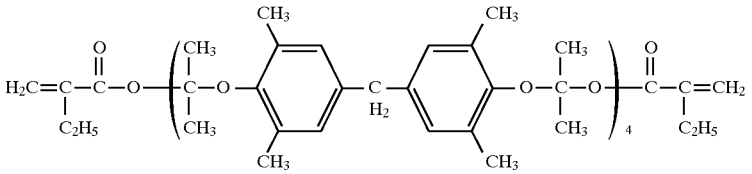
a-7
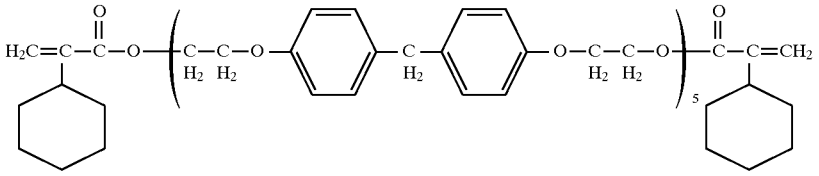
a-8
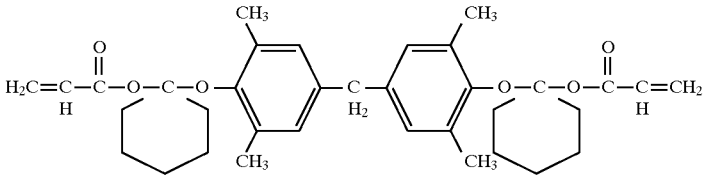
a-9
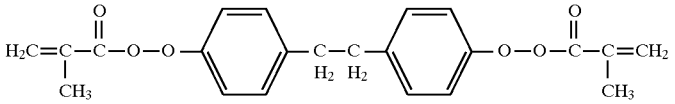
a-10
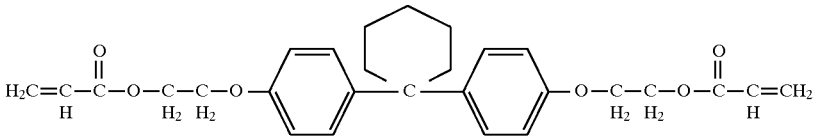
a-11
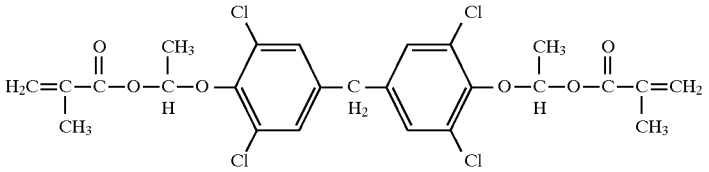

-continued
a-12
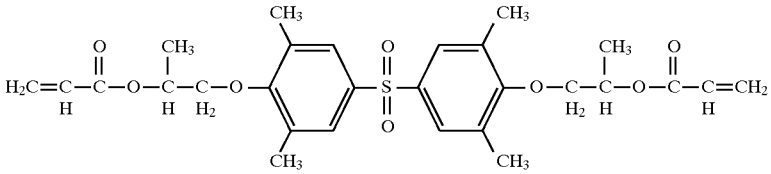
a-13
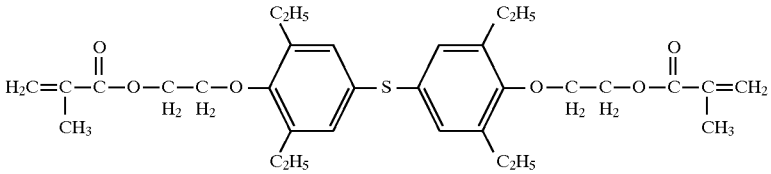
a-14
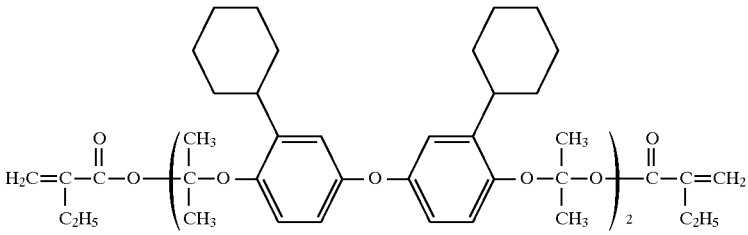
a-15
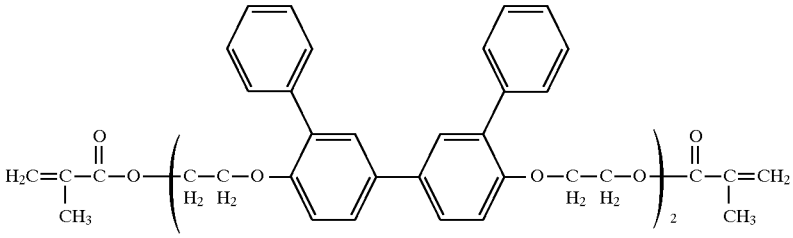
a-16
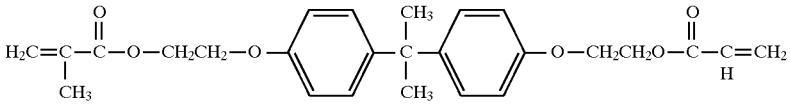
a-17
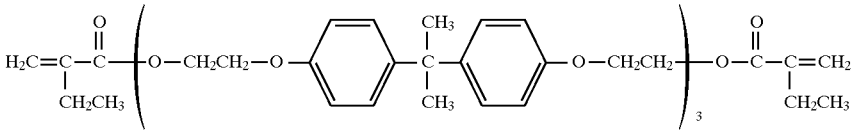
a-18
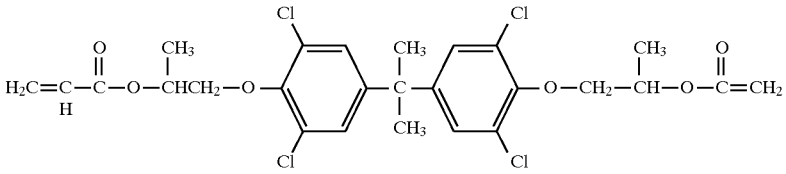
a-19
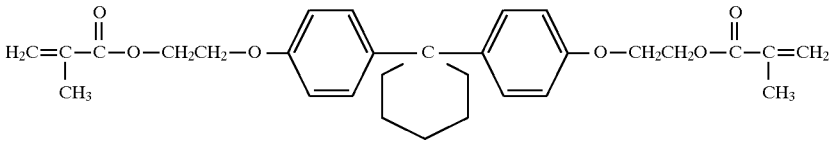
a-20
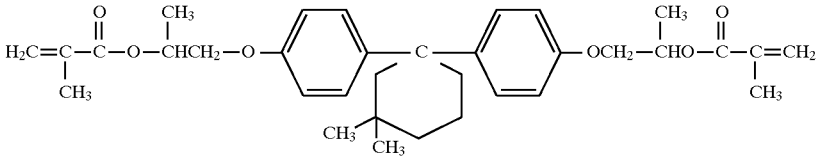

-continued
a-21
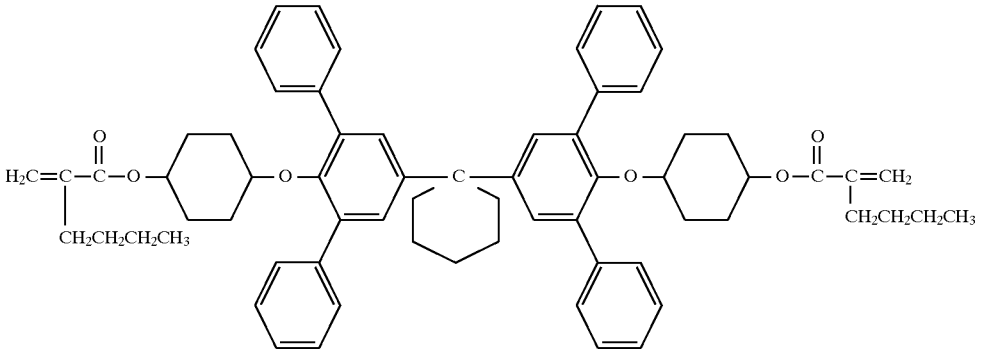
a-22
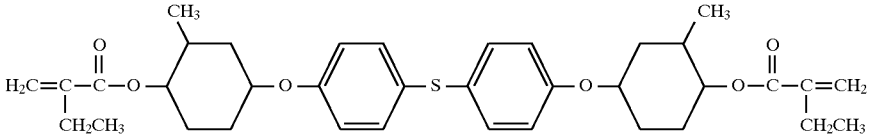
a-23
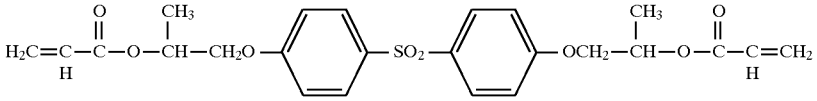
a-24
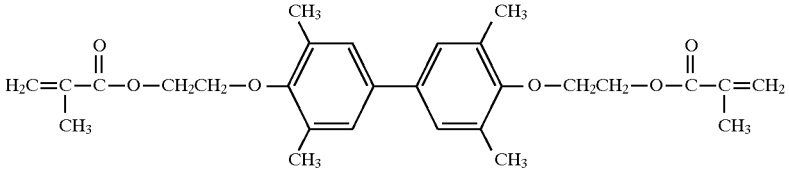
a-25
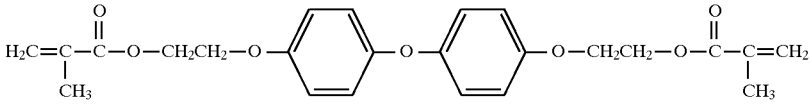
a-26
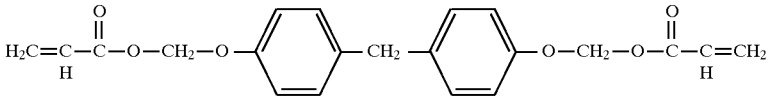
a-27
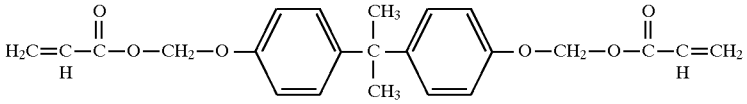
b-1
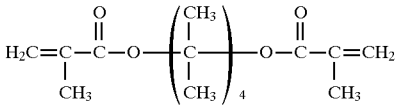
b-2
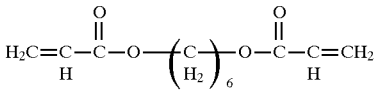
b-3
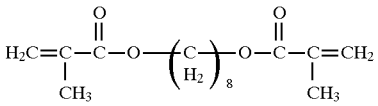
b-4
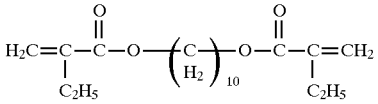

-continued b-5

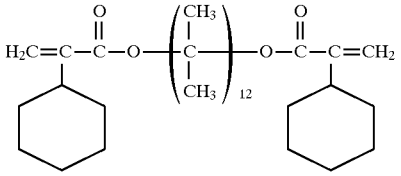

b-6

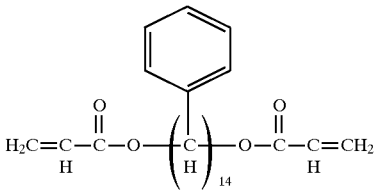

b-7

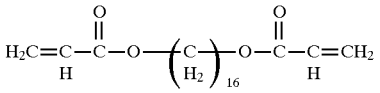

b-8

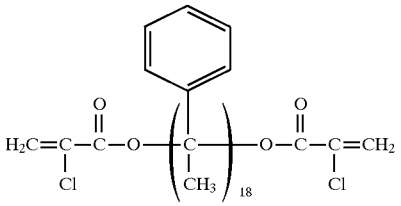

b-9

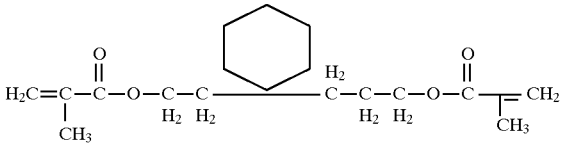

b-10

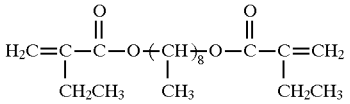

b-11

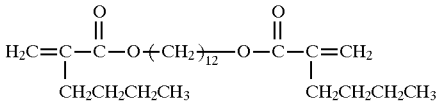

b-12

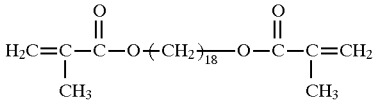

b-13

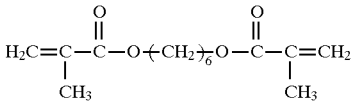

The above-mentioned compounds are easily synthesized, and are commercially available.

When pressure-heating fixing, in order to obtain a glossy fixed image and to maintain favorable hot off-setting property, it is preferable that the ratio between a low molecular weight component area (SLp) having a molecular weight of 1500–80,000 and a high molecular weight component area (SHp) having a molecular weight of 80,000 or more and less than 1,000,000 (SLp/SHp) is 5–15.

In toner resin, a low molecular weight component is an ionomer and aforesaid toner resin is composed of a polymer having an ion-bridge structure and a covalent binding bridge structure, toner particles have extremely excellent strength under normal temperature. Aforesaid toner particles are not crushed due to stress caused by stirring in a developing device. In addition, burying of additives does not occur. Therefore, as is apparent from the results of examples described later, excellent developability and excellent transfer property are stably kept for a long time.

In order to obtain a polymer having an ion-bridge structure and a covalent binding bridge structure, a semi-ester compound represented by Formula (c) can be used.

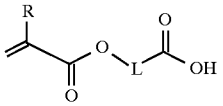

Wherein, R represents a hydrogen atom or a methyl group. L represents a divalent binding group having an ester-bond in a molecule chain in which the number of carbon atom is 3 or more.

A semi-ester compound is a compound contained in a monomer component in order to introduce an ion-bridge structure into a polymer. Aforesaid semi-ester compound can be obtained by an esterification reaction between a (meta)acrylic acid derivative having a hydroxylic group and a dicarbonic acid. Practically, monomethacryloyloxyethyl succinate and monomethacryloylethyl fumarate are cited.

Though it is possible to introduce an ion-bridge structure into a polymer by means of a normal (meta)acrylic acid monomer, polymers employing specific semi-ester compounds are preferable since the position of carboxylic group is kept away from the main chain due to the resulting long side chain and thereby it is difficult to receive steric hindrance. Due to this, ion-bridge between aforesaid polymer and a multi-valent metal compound can effectively be produced.

In order to introduce an ion-bridge structure, a multi-valent metal may be reacted with a polymer obtained from a monomer component containing a specific semi-ester compound. Due to coordinate bonding between a carboxylic group and a metal ion, an ion-bridge structure is formed. Here, as suitable multi-valent metal compounds, for example, alkaline earth metal, acetic acid salt of zinc group metal and oxides are cited.

A polymer into which an ion-bridge structure and a covalent binding bridge structure have been introduced is relieved of its brittleness. In addition, sufficient strength under normal temperature is exhibited. As a result, aforesaid polymer is not crushed due to stress caused by stirring in a developing device and burying of additives in the toner is inhibited.

From the viewpoint of coagulation property, the glass transition point temperature of the vinyl-based binder resin is preferably 45° C. or more. As a synthesis method of aforesaid vinyl-based binder resin, a suspension polymerization method, an emulsification polymerization method, a solution polymerization method and a block polymerization method can be utilized.

In the toner, polyolefine may be incorporated. As polyolefine, for example, polymers of an olefine monomer such as ethylene, propylene, butene, pentene, hexene, heptene, octene, nonene, decene, 3-methyl-1-butene, 3-methyl-2-pentene, 3-propyl 5-methyl-2-hexene or copolymers between the above-mentioned olefine monomer and acrylic acid, methacrylic acid and vinylacetic acid are cited. Specifically, polypropylene is preferable. The polyolefin is preferably kneeded in a colored particles of the toner.

The content amount of the above-mentioned polyolefines is preferably 0.5–10 wt % and more preferably 1–5 wt % in a colored particles of the toner.

Colorant

In order to color the toner, carbon black, magnetic substances, dyes and pigments which are ordinarily used can be used.

As a black colorant, carbon black and magnetic substances are cited. As examples of carbon black, channel black, furnace black, acetylene black, thermal black and lamp black are cited. As a magnetic substance, ferromagnetic metals such as iron, nickel and cobalt, alloys containing the above-mentioned metals, ferrite, and ferromagnetic metal compounds such as magnetite alloys exhibiting ferromagnetic property due to heat processing while not containing ferromagnetic metals including Heusler's alloys such as manganese-copper-aluminum and chromium dioxide can be used.

With regard to the examples of dyes, as magenta use, C.I. Solvent Red 1, 49, 52, 58, 63, 111 and 122 are cited. As yellow use, C.I. Solvent Yellow 19, 44, 77, 79, 81, 82, 93, 98, 103, 104, 112 and 162 are cited. As cyan use, C.I. Solvent Blue 25, 36, 60, 70, 93 and 95 can be used. Mixtures thereof can also be used.

With regard to the examples of pigments, as magenta use, C.I. Pigment Red 5, 48:1, 53:1, 57:1, 122, 139, 144, 149, 166, 177, 178 and 222 and C.I. Pigment Orange 31 and 43 are cited. As yellow use, C.I. Pigment Yellow 14, 17, 93, 94 and 138 are cited. As cyan use, C.I. Pigment Green 7 and C.I. Pigment Blue 15:3 and 60 are cited. Mixtures thereof can also be used.

It is preferable that the average primary particle size by number of the above-mentioned dyes and pigments are generally 10–200 nm, though it varies depending upon the kind thereof.

A sufficient amount of the above-mentioned colorants for forming an image must be employed. Practically, 1–10 wt % in the colored particles of the toner is preferable.

It is preferable that a master batch in which a pigment is dispersed and contained at high density in a part of the binder resin employing a flushing step in advance and that aforesaid master batch and a remaining portion of the binder resin are mixed for producing color toner. The color toner thus prepared is excellent in terms of dispersion property and the wettability of the binder resin. It has anti-crushability of the toner and anti-off-setting performance in which excellent coloring property is further improved.

Various additives

In the toner, various internal additives and external additives such as a charge controller may be incorporated as necessary. With regard to a charge controller, color toner particles use constitutes its part, colorless and white color are preferable. As practical example of a preferable charge controller, a zinc salt of salicylic acid derivative are cited.

As an external additive, conventional fine particles such as inorganic fine particles and organic fine particles and lubricants composed of an aliphatic acid and aliphatic acid metal salt can be used. Specifically, by adding aliphatic acid metal salt, abrasion coefficient between toner particles and other substances is reduced. As a result, stress which the toner receives is reduced so that crushing of toner particles and burying of external additive can further effectively be minimized.

Manufacturing examples and particle size range

The particle size of toner is 1–30 $\mu$m. In order to obtain an image having a favorable resolution and surface flatness, it is preferably 3–9 $\mu$m in terms of average particle size by volume.

The toner can also be used as a one-component developer composed only of toner. In addition, the toner may be mixed with carrier for making a two-component developer. As aforesaid carrier, conventional ones can be used. By the use of carrier having low magnification and small specific gravity, stress which the toner particles receive while being stirred for mixing is reduced.

Practically, carrier in which magnification is 15–40 emu/g and specific gravity is 3–7 g/cm$^3$ can preferably be used. From viewpoint of favorable carrier durability, carrier in which a resin-laminated layer is formed on the surface of a magnetic substance particles and carrier in which the magnetic powder is dispersed in a resin particles can preferably be used.

The toner can be used suitably for fixing process by means of pressure and heating fixing such as a heating rollers. When a heating roller employed in the fixing process is a soft roller in which the surface layer which contacts the surface of unfixed image on a recording medium is constituted of an elastic body, compatibility with unevenness on the surface of an unfixed image is favorable. In addition, flatness on the surface of the fixed image can further be improved.

An unfixed toner image formed on an electrostatic carrier such as a photoreceptor is transferred onto a recording medium. The transferred toner image is carried as a final image due to fixing. The recording medium is ordinarily a plain paper. In addition, a transparent resin film for OHP use or various paper and a resin plate are included.

Fixing method

As a typical fixing method, a heating roller fixing method and a pressure heating and fixing method employing a fixing film can be cited.

Since the toner is excellent in terms of fixing property at low temperature, the anti-off-setting property and anti-filming property are excellent. If the toner of the present invention is used for the fixing method, a high-grade image can be obtained without shortening the functional life of the heating roller fixing device employed in the heating roller fixing system or a fixing film used for a pressure heat fixing system.

The heating roller fixing method will now be explained referring to FIG. 1. There is provided upper roller 1 having a heating source inside its metallic cylinder, which is constituted by iron or aluminum, whose surface is covered with tetrafluoroethylene or a polytetrafluoroethyleneperfluoroalkoxy vinyl ether copolymer, and there is also formed lower roller 2 made of silicone rubber. Specifically, upper roller 1 has a line heater 3 as heating source so that the temperature of the surface of upper roller 1 is heated to about 100° to 200° C. At the fixing unit, pressure is provided between upper roller 1 and lower roller 2 so that at least lower roller 2 is deformed. Accordingly, the so-called "nip" is formed. The nip width is ordinarily 1 to 10 mm, and preferably 1.5 to 7 mm. Fixing speed is preferably 40 to 4000 mm/sec.

The fixing method having a heating body fixed and mounted in which a fixing film is used will now be explained referring to FIG. 2. Numeral 21 is a line-shaped heating material, with low heat capacity, which is fixed and supported on an apparatus. Electric current is passed at both ends wherein an electric resistance material is coated at thickness of 1.0 to 2.5 mm on alumina board whose thickness is 0.2 to 5.0 mm and preferably 0.5 to 3.0 mm, the width is 10 to 15 mm and the length is 240 to 400 mm. An electric current of DC 100 V is flowed through the line-shaped heating materials 21 in the form of a pulse of 25 msec. in frequency in such a manner that the pulse width is modulated on the basis of the temperature measured by temperature sensor and pulse width in accordance with energy releasing amount. Provided that temperature, sensed at line-shaped heating material 21 with low heat capacity, by means of temperature sensor is T1, surface temperature T2 of film member 14 which faces the resistance material is lower than T1. Here, T1 is preferably 120° to 220° C. The temperature of T2 is preferably lower than that of T1 by 0.5° to 10° C. Surface temperature T3 of film member 14 at a point where film member 14 is peeled off from the surface of toner is almost equivalent to T2.

Figure 2:
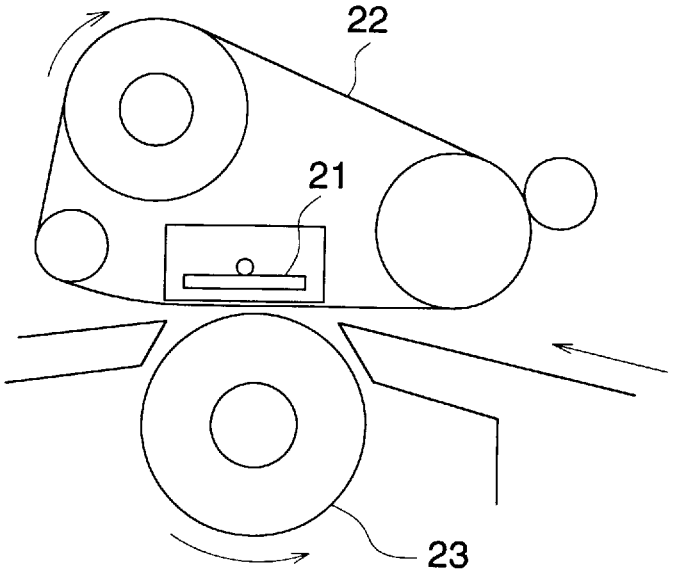
FIG. 2 is an explanation drawing showing an example of a fixing method by the use of a heating material fixed and mounted (using an endless sheet).

In the above-mentioned manner, film member, after being brought into contact with the heating material whose energy and temperature are controlled, moves toward the arrow direction in FIG. 2. The above-mentioned fixing film 22 is a endless film whose thickness is 10 to 35 μm, made of polyester, polyperfluoroalkoxyvinyl ether, polyimide and polyether imide, covered with a releasing agent layer, whose thickness is 5 to 15 μm, wherein a conductive member is added to a fluorine resin such as Teflon. Ordinarily, film member 14, whose total thickness is 10 to 100 μm, is conveyed toward the arrowed direction due to the driving and tension by means of driving roller 11 and driven roller 12 without wrinkle or crumpling. The fixing speed is preferably 40 to 400 mm/sec. Pressure roller 23 has an elastic rubber layer having high releasing property such as silicone rubber. Pressure roller 23 has a rubber elastic layer having parting property such as silicone rubbers. At a total pressure of 2–30 kg, the pressure roller presses the heating material for pressing and rotating.

Figure 3:
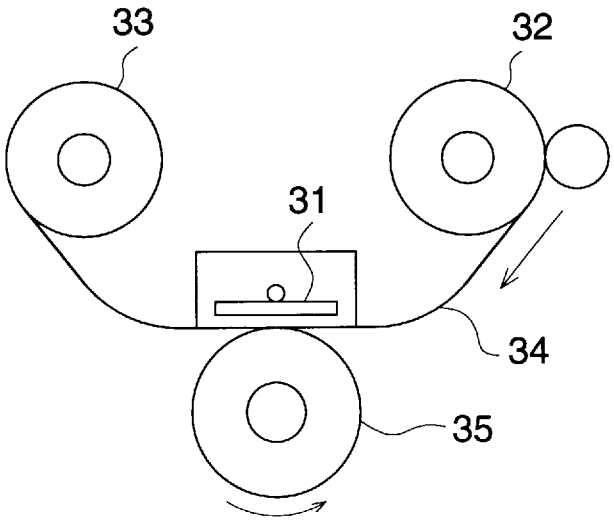
FIG. 3 is an explanation drawing showing an example of a fixing method by the use of a heating material fixed and mounted (using a double-ended film).

While FIG. 2 uses an endless sheet, FIG. 3, wherein double-ending film 34 is rolled on sheet feeding shaft 32 and winding shaft 33 and a film is caused to move toward the arrowed direction as fixing advances. Between aforesaid double-ending film 34 and pressure roller 35 are caused to pass the recording medium which carries toner image. By passing heating substance 31, toner image is molten fixing onto a recording medium.

In a heat roller fixing method, it is preferable to employ a rotating fixing roller in which a silicone oil coating is formed on the surface thereof and a pressure roller being brought into contact with the fixing roller.

In Formula I, X represents a saturated hydrocarbon group of an alkyl group having 1 through 4 carbon number such as a methyl group and an aryl group such as a phenyl group. $R_f$ represents a fluoroalkyl group having 2–10 carbon atoms. Formula

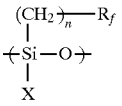

wherein X represents a saturated hydrocarbon group of an alkyl group having 1 through 4 carbon atoms such as a methyl group and an aryl group such as a phenyl group; and $R_f$ represents a fluoroalkyl group having 2 through 10 carbon atoms.

$R_f$ preferably represents a group represented by $Z—(CF_2)_m—$ (wherein Z represents a hydrogen atom or a fluorine atom; and m represents an integer of 2–10 and preferably 2–8; and n represents an integer of 1–4.

A fluorine-containing-silicone oil may have a copolymer structure with dimethyl silicone, phenylmethylsilicone or diphenylsilicone, in addition to the above-mentioned repetitive unit.

It is preferable that the fluorine-containing-based is liquid state having an appropriate viscosity when using. Accordingly, the viscosity of the silicone oil of the present invention at 25° C. is preferably 20–1000 cs and more preferably 100–500 cs.

Viscosity of the fluorine-containing-based silicone oil can be adjusted by controlling the degree of polymerization. Aforesaid viscosity represents dynamic viscosity measured by a Ubbelohde viscositymeter in accordance with ASTM D 445-46T or JIS Z8803.

When the fluorine-containing-based silicone oil is a copolymer, it is preferable that a structural unit represented by Formula I is contained by 20 mole % or more.

Ordinary silicone oil is synthesized as follows: Dialkyl-substituted dichlorosilane is reacted with silicon and alkyl-chloride. The resulting compound is subjected to hydrolysis for preparing siloxane, and then after forming a cyclic oligomer or a line-shaped oligomer, the above-mentioned compounds are polymerized.

The fluorine-containing-based silicone oil compound has a fluorinated alkyl group on the side chain. In this occasion, it is easily manufactured by the use of a fluorine-based compound having a chlorine atom, for example having a structure exhibited by the following Formula (d), at the end of all of and/or a part of alkyl chloride in place of the above-mentioned alkyl chloride.

Formula (d)

$$Z—(CF_2)_m(CH_2)_nCl$$

wherein m represents an integer of 2 through 10; n represents an integer of 1 through 4; and Z represents a hydrogen or a fluorine element.

Typical and practical examples of compounds represented by Formula (d) will be cited:

$CF_3CF_2CH_2Cl$
$CF_3CF_2CF_2CH_2Cl$
$CF_3CF_2CF_2(CH_2)_2Cl$
$CF_3CF_2CF_2CF_2(CH_2)_2Cl$
$CF_3CF_2CF_2CF_2CF_2CH_2Cl$
$CF_3CF_2CF_2CF_2CF_2(CH_2)_3Cl$
$CF_3CF_2CF_2CF_2CF_2CF_2CH_2Cl$
$CF_3CF_2CF_2CF_2CF_2CF_2CF_2CH_2Cl$
$HCF_2CF_2CH_2Cl$
$HCF_2CF_2CF_2(CH_2)_2Cl$
$HCF_2CF_2CF_2CF_2CH_2Cl$
$HCF_2CF_2CF_2CF_2(CH_2)_2Cl$
$HCF_2CF_2CF_2CF_2(CH_2)_4Cl$
$HCF_2CF_2CF_2CF_2CF_2(CH_2)_3Cl$
$HCF_2CF_2CF_2CF_2CF_2CF_2CH_2Cl$

As an alkyl chloride which introduces an alkyl group other than an alkyl fluoride group in the present invention, methyl chloride, ethyl chloride, propyl chloride and butyl chloride can be cited.

The carbon number of the preferable alkyl fluoride is 1 through 10. It is preferable that the portion which directly connect with the silicon atom is a methylene chain. The range of carbon number of the specifically preferable alkyl fluoride is 2 through 8.

The structure of typical and practical examples of the fluorine-containing-based silicone oil of the present invention will be exhibited as follows:

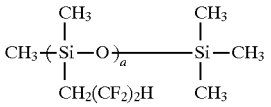
(1)
Viscosity:450cs

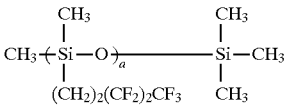
(2)
Viscosity:250cs

-continued

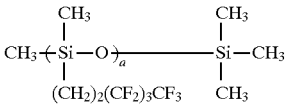
(3)
Viscosity:300cs

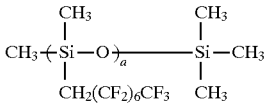
(4)
Viscosity:500cs

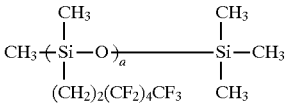
(5)
Viscosity:350cs

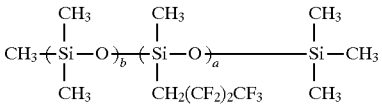
(6)
Viscosity:320cs
a:b = 80:20

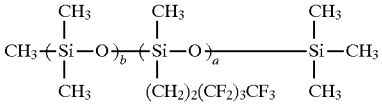
(7)
Viscosity:300cs
a:b = 60:40

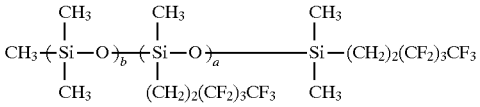
(8)
Viscosity:300cs
a:b = 70:30

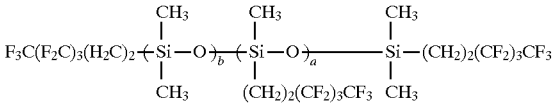
(9)
Viscosity:300cs
a:b = 80:20

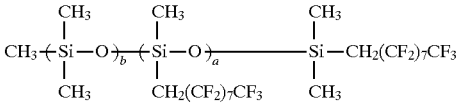
(10)
Viscosity:450cs
a:b = 50:50

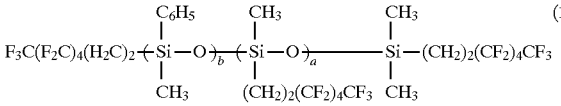
(11)
Viscosity:200cs
a:b = 30:70

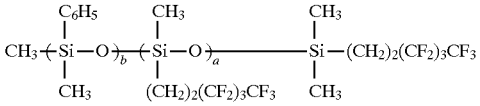
(12)
Viscosity:500cs
a:b = 90:10

-continued

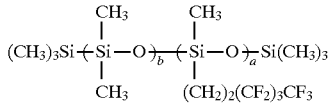

(13)

Viscosity:300cs
a:b = 20:80

In the above-mentioned compounds, a and b respectively represent an integer of 1 and more. Preferably, they are integers of 10–2000. More preferably, 100–1000. In order to obtain suitable viscosity, a and b are appropriately selected.

This heat fixing method will now be explained referring to FIG. 4. There is provided upper roller 41 having heating source 44 inside metallic cylinder 43, which is constituted by iron or aluminum, whose surface is covered with tetrafluoroethylene or a polytetrafluoroethyleneperfluoroalkoxy vinyl ether copolymer, and there is also provided lower roller 45 made of silicone rubber. Specifically, upper roller 41 has a line heater as heating source 44 so that the temperature of the surface of upper roller 41 is heated to about 120° to 200° C. Between this upper roller 41 and lower roller 45, recording member 46 which carries toner image 47 is passed through so that toner image 47 is heat-fused-fixed onto recording member 46. According to conventional heat roller fixing methods, a part of fused toner adhered on upper roller 41. After one rotation, off-set phenomenon, i.e., toner adhered on aforesaid upper roller 41 is adhered on another portion occurs. The extreme case is that the toner adhered on upper roller 41 is not separated from the recording medium. As a result, a problem that a rolling phenomenon in which aforesaid toner is rolled on the upper roller together with the recording medium and simultaneously with this, the fixing roller is contaminated occurred. At the fixing unit, pressure is provided between upper roller 41 and lower roller 45 so that lower roller 45 is deformed. Accordingly, the so-called "nip" is formed. The nip width is ordinarily 1 to 10 mm, and preferably 1.5 to 7 mm. Fixing speed is preferably 40 to 400 mm/sec. When the nip width is too small, heat cannot be provided to toner uniformly, easily resulting in the occurrence of uneven fixing. To the contrary, when the nip width is too large, fusion of resin is promoted so that offset phenomenon tends to become easily.

Resin used for the toner of the present invention is composed of a vinyl-based polymer, it has a peak molecular weight of tetrahydrofuran (THF) dissolution components at the molecular weight region of 5,000 or more and less than 15,000 and also having a peak molecular weight of tetrahydrofuran (THF) dissolution components at the molecular weight region of 300,000 or more and less than 500,000. It contains a low molecular weight component—it is a component having a peak molecular weight at the molecular weight region of 5,000 or more and less than 15,000 and a high molecular weight component—it is a component having a peak molecular weight at the molecular weight region of 300,000 or more and less than 500,000.

On surface 42 of upper roller 41, a fluorine-containing-based silicone oil layer is formed. Due to interaction between aforesaid layer and the toner, effective fixing is conducted.

The fluorine-containing-based silicone oil layer is formed on surface 32 of upper roller 31 as follows: On surface 42 of upper roller 41 in the longitudinal direction, impregnating roller 48 is brought into contact with and is rotating in an arrow direction. Aforesaid impregnating roller 48 impregnates the fluorine-containing-based silicone oil in advance. When fixing, in accordance with the rotation of upper roller 41, the fluorine-containing silicone oil is fed onto the surface of upper roller 41 from impregnating roller 48 extremely small amount by small. As a result, on surface 42 of upper roller 41, the fluorine-containing silicone oil layer is formed.

EXAMPLES

Hereinafter, the present invention will be explained in detail referring to Examples. In the following sentences, "part" refers to "part by weight".

Example 1

Preparation of a polymer (binder resin)

In a separable flask equipped with a thermometer, stirrer, a nitrogen gas-introduction tube and a flow-down type capacitor, toluene was poured. By introducing a nitrogen gas from the gas introduction tube, the inside atmosphere was arranged to be inactive. Following this, aforesaid toluene was heated in an oil bath to cause the toluene at a reflux temperature. Next, solution polymerization was conducted in such a manner that, in 100 parts of toluene, a mixture in which 75 parts of styrene, 20 parts of n-butylacrylate and 4 parts of di-t-butylperoxide as a polymerization initiator were dripped so that a polymer was obtained.

By dripping a mixture in which 700 parts of styrene, 150 parts of methylmethacrylate, 150 parts of n-butylacrylate, 20 parts of compound (a-20) represented by Formula (a) and 5 parts of methylmethacrylate, 40 parts of di-t-butyl peroxide were dissolved in 1000 parts of toluene into a flask containing the above-mentioned obtained polymer solution having a high molecular weight, polymerization reaction was conducted.

After dripping the above-mentioned solution, the resulting mixture was subjected to ripening for 5 hours while stirring at a temperature at which toluene is boiled, a polymer in which a low molecular weight component was obtained. Next, zinc oxide was added to the flask having high molecular weight components and low molecular weight components. The resulting mixture was stirred at reflux temperature to accelerate the reaction. Following this, while raising the temperature of a system to 180° C., toluene was removed from the solution by evacuation, and then the resulting solution was cooled and crushed for obtaining resin A obtained.

Preparation of the pigment master batch

The resulting polymer resin and magenta pigment "C.I. Pigment Red 122" were mixed at a ratio of 6:4 in terms of weight ratio. The resulting mixture was subjected to flushing processing for preparing a pigment master batch. This is defined to be "MB1". In the same manner except that yellow pigment "C.I. Pigment Yellow 17" was employed, a pigment master batch was obtained. This is defined to be MB2". In addition, in the same manner except that "C.I. Pigment Blue 15:3" was employed as a pigment, a pigment master batch was obtained. This is defined to be "MB3".

Toner production

In a Henschel mixer, 100 parts of polymer resin obtained in advance, 20 parts of pigment master batch and 3 parts of zinc salt of 3,5-di-tertiary butyl salicylic acid were mixed. Next, the resulting mixture was molten kneaded by means of a bi-axial type extruder, and then cooled, solidified and coarsely crushed. Following this, colored particles having particle size by volume was 8.5 $\mu$m was obtained by the use of a particles-collision type fine powder coarse crusher and an air-flow type classifying device. To 100 parts of the resulting colored particles, 0.5 part of hydrophobic silica "R-972" (produced by Japan Aerosil Inc.) and 1.0 part of hydrophobic titania "T-805" (produced by Japan Aerosil Inc.) were mixed. The resulting mixture was subjected to mixing processing by the use of a Henshel mixer for manufacturing toner T1.

Toners T2 to T4 and H1 to H4 were prepared in the samen manner as Toner T1, provided that the polymerizing formulation was modified as shown in Table 1.

TABLE 1

| | High Molecular Weight Component Composition (Parts) | | | Low Molecular Weight Component Composition (Parts) | | | | | | |
|---|---|---|---|---|---|---|---|---|---|---|
| Toner | St | MMA | BA | St | MMA | BA | Ac-1 | Compound (a) | Compound (b) | ZnO |
| T1 | 75 | 5 | 20 | 700 | 150 | 50 | 25 | 20 | — | 5 |
| T2 | 70 | 10 | 20 | 700 | 200 | 100 | 25 | 25 | — | 6 |
| T3 | 75 | 10 | 15 | 750 | 100 | 150 | 20 | — | 20 | 6 |
| T4 | 70 | 15 | 15 | 750 | 150 | 100 | 20 | — | 25 | 5 |
| H1 | 75 | 5 | 20 | 700 | 150 | 50 | 20 | — | — | 5 |
| H2 | 75 | 10 | 15 | 750 | 100 | 150 | 25 | — | — | 6 |
| H3 | 75 | 10 | 15 | 750 | 100 | 150 | — | — | — | — |
| H4 | 70 | 5 | 15 | 750 | 150 | 100 | 20 | — | — | — |

St: Styrene
MMA: Methylmethacrylate
BA: Butylacrylate
Ac-1: Monomethacryloyloxyethyl succinate
ZnO: Zinc oxide

TABLE 2

| Toner | Area Ratio (SLp/SHp) | 160° C. $G'_{160}$ | 160° C. $G''_{160}$ | 180° C. $G'_{180}$ | 180° C. $G''_{180}$ |
|---|---|---|---|---|---|
| T1 | 14 | 550 | 1700 | 350 | 870 |
| T2 | 8 | 970 | 2900 | 580 | 1500 |
| T3 | 14 | 600 | 1900 | 400 | 950 |
| T4 | 8 | 1000 | 2900 | 600 | 1750 |
| H1 | 18 | 370 | 770 | 290 | 700 |
| H2 | 4 | 2100 | 3400 | 1100 | 2340 |
| H3 | 18 | 490 | 1480 | 280 | 710 |
| H4 | 3 | 1440 | 3550 | 1200 | 2400 |

Manufacturing of Carrier

On the surface of a Cu-Fe-based core particles in which the average particle size by volume was 45 $\mu$m and the specific gravity was 5.0, a resin-laminated layer composed of a styrene-methylmethacrylate resin (4:6 (mol ratio)) in the ratio of 2.0 wt % per aforesaid core particle for preparing a resin-laminated carrier was prepared.

Preparation of Developer

By mixing each of toners obtained in the above-mentioned Examples (T1 through T4 and H1 through H4) and the above-mentioned resin-laminated carrier in a V-shaped mixer in such a manner that toner density would be 7%, developers 1 through 4 and 11 through 14 were prepared.

Evaluation of Developer

Developers 1 through 4 and 11 through 14 thus obtained were subjected to an image forming test and developer's mixing and stirring test so that glossiness (flatness on the surface of an image), anti-off-setting performance and toner particle size (anti-crushing property) were evaluated.

Glossiness and anti-off-setting performance were evaluated by forming a fixed image by the use of a full-color copying machine "Konica 9028" (produced by Konica Corporation) modified in such a manner that both of upper and lower rollers in the fixing device had an LTV rubber layer.

With regard to toner particle size, by the use of a full color copying machine "Konica 9028" (produced by Konica Corporation) modified in such a manner that developing devices had a structure to be able to be driven singly, each of the above-mentioned developer were charged in the developing devices. At 40° C. and 60% RH, each developer was subjected to mixing and stirring for 3 hours for evaluation.

Evaluation issues (1) Glossiness (Flatness on the surface of an image)

The surface temperature of the fixing rollers and the surface temperature on the pressure roller were set at 180° C. The glossiness of a fully fixed image formed were measured in accordance with JIS Z 8741.

(2) Anti-off-setting performance

The surface temperature of the fixing rollers and the pressure roller was gradually increased. Temperature when the hot off-setting occurred was measured.

(3) Toner particle size (Anti-crushability)

Before and after stirring toner in the developing device, average particle size by volume of the toner was measured.

Table 3 shows the results thereof.

TABLE 3

| Developer | Toner | Glossiness (%) | Anti-offsetting property (°C.) | Before mixing and stirring: Particle size $\mu$m | Before mixing and stirring: Developability mg/cm$^2$ | Before mixing and stirring: Image transfer property % | 3 hours after stirring: Particle size $\mu$m | 3 hours after stirring: Developability mg/cm$^2$ | 3 hours after stirring: Image transfer property % |
|---|---|---|---|---|---|---|---|---|---|
| 1 | T1 | 31 | 200° C. | 8.5 | 1.02 | 90 | 8.5 | 1.01 | 89 |
| 2 | T2 | 27 | 200° C. or more | 8.6 | 1.04 | 91 | 8.5 | 1.03 | 90 |

TABLE 3-continued

| Developer | Toner | Glossiness (%) | Anti-offsetting property (°C.) | Before mixing and stirring: Particle size μm | Before mixing and stirring: Developability mg/cm² | Before mixing and stirring: Image transfer property % | 3 hours after stirring: Particle size μm | 3 hours after stirring: Developability mg/cm² | 3 hours after stirring: Image transfer property % |
|---|---|---|---|---|---|---|---|---|---|
| 3 | T3 | 30 | 200° C. or more | 8.5 | 1.03 | 89 | 8.5 | 1.01 | 88 |
| 4 | T4 | 26 | 200° C. or more | 8.5 | 1.03 | 89 | 8.5 | 1.01 | 88 |
| 11 | H1 | 8 | 160° C. or less | 8.5 | 1.03 | 90 | 7.5 | 0.80 | 78 |
| 12 | H2 | 12 | 200° C. or more | 8.6 | 1.05 | 92 | 7.5 | 0.82 | 79 |
| 13 | H3 | 16 | 160° C. or less | 8.5 | 1.02 | 91 | 6.5 | 0.63 | 64 |
| 14 | H4 | 10 | 200° C. | 8.5 | 1.03 | 90 | 7.1 | 0.79 | 75 |

Results of Table 3 exhibits that toners T1 through T4 are excellent in terms of all of glossiness, anti-off-setting performance and anti-crushability so that stable color fixed image can be formed. On the contrary, H1 through H4 cannot respectively provide the above-mentioned performance with well balance.

Toner 5

Preparation of a polymer (binder resin)

In a separable flask equipped with a thermometer, stirrer, a nitrogen gas-introduction tube and a flow-down type capacitor, toluene was poured. By introducing a nitrogen gas from a gas introduction tube, the inside atmosphere was arranged to be inactive. Following this, aforesaid toluene was heated in an oil bath to cause the toluene at a reflux temperature. Next, solution polymerization was conducted while, in 100 parts of toluene, a mixture in which 75 parts of styrene, 5 parts of methylmethacrylate, 20 parts of n-butylacrylate and 4 parts of di-t-butylperoxide as a polymerization starter were dripped so that a polymer was obtained.

By dripping a mixture in which 700 parts of styrene, 150 parts of methylmethacrylate, 150 parts of n-butylacrylate, 20 parts of compound (a-26) represented by Formula (a) and 40 parts di-t-butyl peroxide were dissolved in 1000 parts of toluene into a flask containing the above-mentioned polymer solution having a high molecular weight, polymerization reaction was conducted. After dripping the above-mentioned solution, the resulting mixture was subjected to ripening for 5 hours while stirring at a temperature at which toluene is boiled, a polymer in which a low molecular weight component was obtained. Following this, while increasing the temperature of a system to 180° C., toluene was removed from the solution while evacuation, and then the resulting solution was cooled and crushed for obtaining resin A1 targeted.

Preparation of pigment master batch

The above-mentioned polymer resin A and magenta pigment "C.I. Pigment Red 122" were mixed at a ratio of 6:4 in terms of weight ratio. The resulting mixture was subjected to flushing processing for preparing a pigment master batch.

Toner production

In a Henshel mixer, 1100 parts of resin, 20 parts of pigment master batch prepared and 3 parts of zinc salt of 3,5-di-tertiary butyl salicylic acid were mixed. Next, the resulting mixture was molten kneading by means of a bi-axial type extruder, and then cooled, solidified and coarsely crushed. Following this, colored particles having particle size by volume was 8.5 μm was obtained by the use of a particles-collision type fine powder coarse crusher and an air-flow type classifying instrument. To 100 parts of the resulting colored particles, 0.5 part of hydrophobic silica "R-972" (produced by Japan Aerosil Inc.) and 1.0 part of hydrophobic titania "T-805" (produced by Japan Aerosil Inc.) were mixed. The resulting mixture was subjected to mixing processing by the use of a Henshel mixer for manufacturing toner (T5) of the present invention.

Toner 6

In the same manner as in Toner 5 except that the resin composition of a low molecular weight polymer was styrene of 750 parts, acrylic acid n-butyl of 100 parts, methacrylic acid methyl 150 parts and compound a-27 represented by Formula (a) of 15 parts, toner (T6) was prepared.

Toner 7

In the same manner as in Toner 5 except that the resin composition of a low molecular weight polymer was styrene of 700 parts, acrylic acid n-butyl of 150 parts, methacrylic acid methyl 150 parts and compound b-2 represented by Formula (b) of 20 parts, toner (T7) was prepared.

Toner 8

In the same manner as in Toner 5 except that the resin composition of a low molecular weight polymer was styrene of 700 parts, acrylic acid n-butyl of 100 parts, methacrylic acid methyl 200 parts and compound b-13 represented by the following structural formula of 15 parts, toner (T6) was prepared.

TABLE 4

| | SLp/SHp | 160° C.: $G'_{160}$ (dyn/cm²) | 160° C.: $G''_{160}$ (dyn/cm²) | 180° C.: $G'_{180}$ (dyn/cm²) | 180° C.: $G''_{180}$ (dyn/cm²) |
|---|---|---|---|---|---|
| T5 | 14 | 530 | 1650 | 340 | 860 |
| T6 | 8 | 960 | 2800 | 570 | 1400 |
| T7 | 14 | 590 | 1800 | 390 | 940 |
| T8 | 8 | 980 | 2850 | 590 | 1730 |

Manufacturing of Carrier

On the surface of a Cu-Fe-based core particles in which the average particle size by volume was 45 μm and the specific gravity was 5.0, a resin-laminated layer composed of a styrene-methylmethacrylate resin (4:6 (mol ratio)) in the ratio of 2.0 wt % per aforesaid core particle for preparing a resin-laminated carrier was prepared.

Preparation of Developer

By mixing each of toners (T5 through T8) and the above-mentioned resin-laminated carrier in a V-shaped mixer in such a manner that toner density would be 7%, developers 5 through 8 were prepared.

Evaluation Conditions

In Examples, Konica 9028 modified machine was used as an image forming apparatus for actual copying evaluation. Major modification issues in the apparatus and the major conditions are as follows:

Surface potential on the photoreceptor=−550 V

DC bias=−250 V

AC bias=−50 through −450 V

Dsd=300 μm

Figure 4:
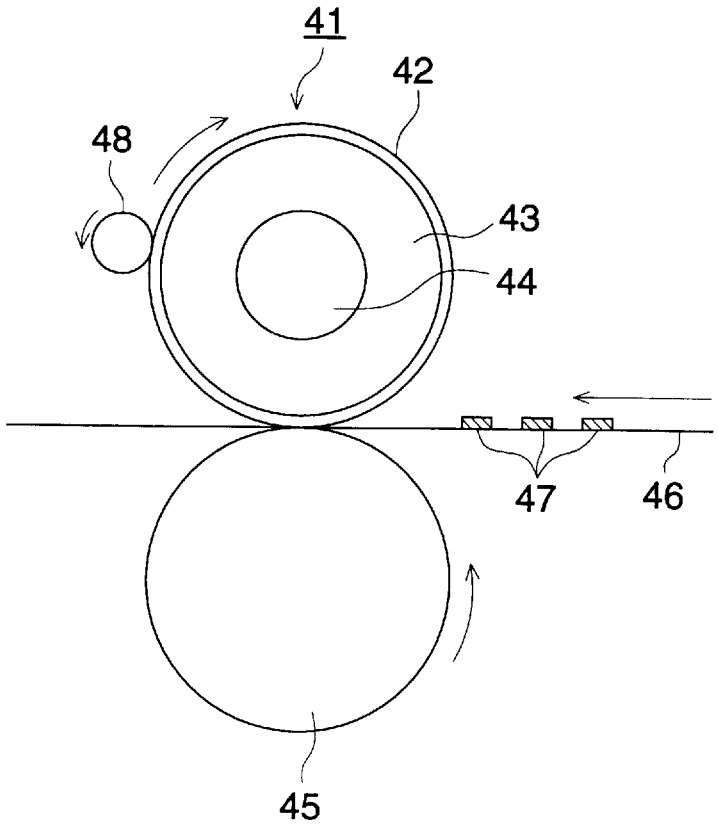
FIG. 4 is a view similar to that of FIG. 1 showing an example of another fixing method.

With regard to fixing performance, a full color copying machine "DC-9028" (produced by Konica Corporation) in which constitution of the fixing device was modified as shown in FIG. 4 and both of upper and lower rollers employ an LTV rubber layers was used for forming a fixed image.

As a fixing condition, process speed was 140 mm/sec.

As a cleaning mechanism of a fixing device, a pad impregnating a fluorine-containing-based silicone oil was loaded to be used. Illustrated compounds (7), (8) and (13) were employed.

In addition, the surface temperature of the fixing device was changeable (120°–200° C.).

Evaluation

The resulting toner was subjected to the following evaluation. Table 5 shows the results thereof.

By the use of a developer employing toner of the present invention and by means of the above-mentioned image formation method, a transmissive image (an OHP image) was prepared on an OHP, and it was evaluated by the following method. Amount of toner sticked was evaluated in a range of 0.7±0.05 (mg/cm$^2$).

With a sheet for OHP on which toner was not carried was used as a reference by means of Self-recording spectrophotometer Model 330 produced by Hitachi Seisakusho, visible spectral transmissivity of an image was measured. Spectral transmissivity at 570 nm was measured to be used for the transmissivity of an OHP image.

TABLE 5

| | Temperature at which off-setting occurs (°C.)/OHP transmissivity (%) | | | | |
|---|---|---|---|---|---|
| | R-1 | R-2 | R-3 | R-Comp 1 | R-Comp 2 |
| T5 | 200/57 | 200/59 | 200/60 | 190/53 | 180/50 |
| T6 | 200/45 | 200 or more/45 | 200 or more/45 | 190/40 | 180/36 |
| T7 | 200 or more/56 | 200 or more/56 | 200 or more/58 | 180/51 | 170/43 |
| T8 | 200 or more/40 | 200 or more/41 | 200 or more/42 | 190/36 | 180/27 |

We claim:

1. Toner for developing electro-static image comprises at least a resin and a colorant, wherein the resin is composed of a vinyl-based polymer, in which component of the resin dissolved in tetrahydrofuran has peaks at the molecular weight region of 5,000 or more and less than 15,000 and at the molecular weight region of 300,000 or more and less than 500,000 in a gel permeation chromatogram, and storage elastic module $G'_{160}$ at 160° C. of the toner is 500 to 1200 dyn/cm$^2$ and loss elastic module $G''_{160}$ at 160° C. of the toner is 1500 to 3000 dyn/cm$^2$.

2. Toner according to claim 1 wherein ratio (SLp/SHp) that is the ratio of area of low molecular weight component (SLp) having molecular weight of 1,500 to 80,000 of the component dissolved in tetrahydrofuran of the resin to area of high molecular weight component (SHp) having molecular weight of 80,000 or more and less than 1,000,000 of the component dissolved in tetrahydrofuran of the resin is 5–15.

3. Toner according to claim 2 wherein low molecular weight component of the above-mentioned polymer is an ionomer.

4. Toner according to claim 2 wherein the low molecular weight component is an ionomer and a polymer having a structural unit obtained from a monomer represented by Formula (a) or (b),

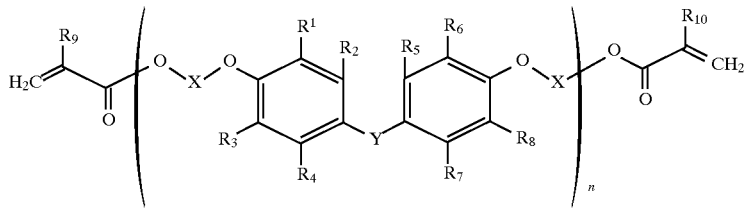

Formula (a)

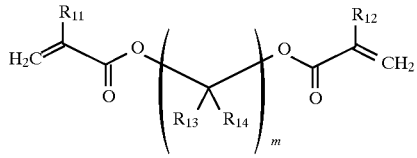

Formula (b)

wherein, $R_1$ through $R_8$ independently are a hydrogen atom, a halogen atom, a substituted or unsubstituted alkyl group having 1 through 10 carbon atoms, a cycloalkyl group or an aryl group, $R_9$ and $R_{10}$ independently are a hydrogen atom or a chained or cyclic alkyl group having 1 through 6 carbon atoms, X is a chained alkylene group having 1 through 6 carbon atoms, a polymethylene group, a chained or cyclic alkylidene group having 2 through 6 carbon atoms or a mere bonding group, Y is a chained alkylene group or a polymethylene group respectively having 1 through 6 carbon atoms or a chained or cyclic alkylidene group, an aryl-substituted alkylidene group, a sulfonyl group, a sulfide group, an —O— group or a mere bonding group respectively having 2 through 10 carbon atoms, n represents numbers of 1 through 5, $R_{11}$ and $R_{12}$ independently are a hydrogen atom or a chained or cyclic alkyl group respectively having 1 through 6 carbon atoms, $R_{13}$ and $R_{14}$ independently are a hydrogen atom and a substituted or unsubstituted alkyl group, cycloalkyl group or aryl group respectively having 1 through 10 carbon atoms, $R_{13}$ and $R_{14}$ may be the same or different, and, $R_{13}$ and $R_{14}$ may be linked together for forming a ring, m represents a number of 3 through 20.

5. Toner according to claim 1 wherein the storage elastic module $G'_{180}$ at 180° C. is 300–1000 dyn/cm$^2$, the loss elastic module $G'_{180}$ at 180° C. is 800–2300 dyn/cm$^2$, the storage elastic module $G'_{160}$ at 160° C. is 500–1200 dyn/cm$^2$ and the loss elastic module $G''_{160}$ at 160° C. is 1500–3000 dyn/cm$^2$.

6. Toner according to claim 5 wherein $G'_{160}>G'_{180}$ and $G''_{160}>G''_{180}$ are satisfied.

* * * * *